US006305860B1

(12) United States Patent
Park

(10) Patent No.: US 6,305,860 B1
(45) Date of Patent: Oct. 23, 2001

(54) SQUEEZING APPARATUS OF A LIQUID ELECTROPHOTOGRAPHIC PRINTER

(75) Inventor: Woo-yong Park, Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/656,135

(22) Filed: Sep. 6, 2000

(30) Foreign Application Priority Data

Nov. 22, 1999 (KR) ..... 99-51925

(51) Int. Cl.[7] ..... B41J 7/26

(52) U.S. Cl. ..... 400/636.3; 400/583; 400/587; 400/637; 400/639; 399/239; 399/246; 399/249

(58) Field of Search ..... 400/583, 587, 400/639, 636.3, 637; 399/239, 246, 249

(56) References Cited

U.S. PATENT DOCUMENTS 5,758,236 * 5/1998 Teschendorf et al. ..... 399/249
6,072,973 * 6/2000 Park ..... 399/249

* cited by examiner

*Primary Examiner*—John S. Hilten
*Assistant Examiner*—Marvin P. Crenshaw
(74) *Attorney, Agent, or Firm*—Sughrue, Mion, Zinn, Macpeak & Seas, PLLC

(57) ABSTRACT

A squeezing apparatus of a liquid electrophotographic printer includes a squeezing roller for squeezing out and removing the carrier from a developer which is applied on a photosensitive belt by its passive-rotational movement while being pressed into tight contact with the photosensitive belt at a certain pressure together with a squeezing backup roller, a squeezing brush selectively coming in contact with the outer circumference of the squeezing roller, for cleaning the squeezing roller by being rotated by a separate driving section, and a squeezing roller slip prevention mechanism disposed on both ends of a shaft of the squeezing roller to come in tight contact with the squeezing backup roller during the pressing of the squeezing roller, for preventing any occurrence of slip of the squeezing roller with respect to the photosensitive belt. The squeezing roller slip prevention mechanism includes a friction roll in friction contact with the squeezing backup roller, a bush bearing for supporting the friction roll with respect to the shaft of the squeezing roller, and an one-way bearing disposed between the bush bearing and the squeezing roller, for permitting free backward-rotation of the squeezing roller with respect to the friction roll in the drip line removing mode.

12 Claims, 6 Drawing Sheets

SQUEEZING APPARATUS OF A LIQUID ELECTROPHOTOGRAPHIC PRINTER

BACKGROUND OF THE INVENTION

1. Field of the Invention

The present invention relates to a liquid electrophotographic printer for performing a printing operation using an ink as a developer which is composed of a power toner and a liquid carrier, i.e. solvent, and more particularly, to a squeezing apparatus of a liquid electrophotographic printer capable of removing the developer left after the developing operation and the carrier of the developer.

2. Description of the Prior Art

Generally, an electrophotographic printer such as, for example, a laser printer, obtains a desired image by the processes of: forming an electrostatic latent image on a photosensitive medium such as a photosensitive drum or photosensitive belt; developing the electrostatic latent image with a toner of a certain color; and transferring the developed electrostatic latent image onto a printed medium. Electrophotographic printers are mainly divided into a wet type and a dry type, depending on the type of toner the printer uses. The wet type electrophotographic printer uses a developer which is composed of a volatile liquid carrier and a toner. The wet type electrophotographic printer is in demand, since it has a higher print quality than the dry type which uses a powder toner, and cannot be damaged by harmful toner dust such as is used in the dry type printer.

FIG. 1 schematically shows the main portions of a wet type electrophotographic printer, which is described below.

As shown in FIG. 1, the wet type electrophotographic printer includes a photosensitive belt 1 disposed on an endless track, and first 2, second 3, and third 4 rollers for rotatably moving the photosensitive belt 1 on its destined path. Here, the third roller 4 is driven by a driving motor (not shown) to rotate the photosensitive belt 1, and the second roller 3 is in the form of a steering roller for preventing the photosensitive belt 1 from skewing by adjusting the tension.

Further, around the photosensitive belt 1, a charging unit 10, exposure unit (not shown), developer unit 20, drying unit 30, and transfer/fixing unit 40 are disposed. Here, the charging unit 10 uniformly charges the photosensitive belt 1, and the exposure unit (not shown) forms an electrostatic latent image on the photosensitive belt 1 by projecting a laser beam onto the photosensitive belt 1 according to an image signal. Further, the developer unit 20 develops the electrostatic latent image on the photosensitive belt 1 by attaching the developer having a certain color toner on the image formative area of the photosensitive belt 1. For a color printer, there are a plurality of exposure units (not shown) for mixing the respective colors, and a plurality of developer units 20 for holding respective colors of toner.

The image formed on the photosensitive belt 1 by the toner and the developer unit 20 is transferred to the printed matter by a transfer roller 41 which is disposed parallel to the first roller 2, while having the photosensitive belt 1 therebetween. The desired image is obtained on the printed matter as the printed matter is fed between the transfer roller 41 and a fixing roller 42, which is parallel from the transfer roller 41 and spaced at a certain interval.

As shown in FIGS. 2 and 3, the developer unit 20 is disposed adjacent to the lower portion of the photosensitive belt 1, and includes a casing 50, developing device 60, and squeezing device 70.

The developing device 60 includes a developing roller 61 which is driven-rotated to selectively come into tight contact with the photosensitive belt 1, developing backup roller 62, and developer jetting nozzle 63 for feeding the developer between the photosensitive belt 1 and the developing roller 61.

The squeezing device 70 performs the first removal of a residual developer left after the developing operation of the developing device 60, and also a liquid carrier from the developer. Here, the liquid carrier has to be removed from the developer during the developing operation, since an excess of liquid carrier on the image formed by the toner hinders the image transference of the transfer/fixing unit 40. The carrier which is not removed by the developer unit 20 is removed to a certain degree by the dry unit 30 which is appropriate for image transference.

The squeezing device 70 is described in greater detail with reference to FIG. 4.

As shown in FIG. 4, the squeezing device 70 includes a squeezing roller 71, squeezing backup roller 72, and a squeezing brush 73.

The squeezing roller 71 and the squeezing backup roller 72 are pressed into tight contact with the photosensitive belt 1 by a certain pressure (approximately of 20 kg/f) by a pressing section which is not shown, to thus squeeze out unnecessary liquid carrier from the developer applied on the photosensitive belt 1 by passive-rotational movement thereof.

Further, during the squeezing operation, the squeezing brush 73 removes the carrier and/or ink toner attached on the squeezing roller 71 by its rotational movement in tight contact with the outer circumference of the squeezing roller 71. The squeezing brush 73 is rotated by the driving force transmitted from a developer roll driving section which is not shown in the drawings.

Further, albeit not shown, the squeezing device 70 includes a driving section for reverse-rotating the squeezing roller 71 during a drip line removing mode, and a squeezing blade 74 (See FIGS. 2 and 3) for removing the ink toner attached on the reverse-rotating squeezing roller 71 in tight contact with the outer circumference of the squeezing roller 71, which is reverse-rotated by the driving section.

As shown in FIG. 2, the squeezing device 70 constructed as defined above squeezes out and removes the carrier from the developer applied on the surface of the photosensitive belt 1 by its reverse-rotational movement while being pressed into tight contact with the surface of the photosensitive belt 1 at a certain pressure. Here, the squeezing brush 73 is in contact with the squeezing roller 71, and accordingly, the squeezing brush 73 removes the carrier and ink toner attached on the squeezing roller 71 while being rotated faster than the squeezing roller 71 by the driving force transmitted from the developer roller driving section.

After completion of the printing mode, a drip line removing mode is performed in which the ink toner unnecessarily attached on the photosensitive belt 1 is removed. In this situation, as shown in FIG. 3, the squeezing roller 71 is pressed with less pressure than in the printing mode, and the squeezing blade 74 is rotated by the driving section in a reverse direction from the rotation direction of the printing operation in contact with the squeezing roller 71, to thus attract unnecessary ink toner from the photosensitive belt 1 thereto during its reverse-rotation. The ink attached on the reverse-rotating squeezing roller 71 is then removed by the squeezing blade 74 which is in contact with the outer circumference of the squeezing roller 71. In such a situation, the developer roller 61 is spaced from the photosensitive belt 1 at a certain interval, and the squeezing brush 73 is spaced from the squeezing roller 71 at a certain interval.

In the squeezing apparatus of the liquid electrophotographic printer operating as above, it is very important to rotate the squeezing roller 71, which is passive-rotated in contact with the photosensitive belt 1, at the same speed as the travel speed of the photosensitive belt 1 without causing a slip occurrence. In the event of slippage due to different relative speeds of the photosensitive belt 1 and the squeezing roller 71, the image formed on the photosensitive belt 1 is smeared and blurred, causing print quality deterioration. Accordingly, the slippage must be prevented during the passive-rotation of the squeezing roller 71.

In the conventional squeezing apparatus, however, since the squeezing brush 73 in contact with the squeezing roller 71, which is passive-driven in contact with the photosensitive belt 1 is rotated faster than the squeezing roller 71, torque is transmitted to the squeezing roller 71 from the squeezing brush 73, and the squeezing roller 71 is therefore rotated faster than the photosensitive belt 1. Accordingly, slipping occurs, i.e., the squeezing roller slides on the photosensitive belt 1. As a result, the image is inevitably blurred.

SUMMARY OF THE INVENTION

The present invention has been made to overcome the abovementioned problems of the prior art, and accordingly, it is an object of the present invention to provide a squeezing apparatus of a liquid electrophotographic printer capable of preventing image smearing which is caused due to a slip, by preventing a slip occurrence between a photosensitive belt and squeezing roller, i.e., by rotating the squeezing roller at the same speed as the traveling speed of the photosensitive belt regardless of the squeezing brush's driving status and/or other loads.

The above object is accomplished by the squeezing apparatus of the liquid electrophotographic printer according to the present invention, including: a squeezing roller for squeezing out and removing the carrier from a developer which is applied on the photosensitive belt by its passive-rotational movement while being pressed into tight contact with the photosensitive belt with a certain pressure together with a squeezing backup roller, and a slip prevention mechanism disposed on both ends of a shaft of the squeezing roller to come in tight contact with the squeezing backup roller during the pressing of the squeezing roller, for preventing any occurrence of slipping of the squeezing roller with respect to the photosensitive belt.

According to the present invention, since the squeezing roller is passive-rotated while being pressed into tight contact with the squeezing backup roller with a high friction force by the slip prevention mechanism, the squeezing roller can be rotated at the same speed as the travel speed of the photosensitive belt even when a load from other elements is exerted thereto, without causing any slippage. Accordingly, the image smearing or blur caused due to the slip of the squeezing roller is prevented.

Here, the slip prevention mechanism includes: a friction roll in friction contact with the squeezing backup roller; a bush bearing for supporting the friction roll with respect to the shaft of the squeezing roller; and a one-way bearing disposed between the bush bearing and the squeezing roller, for locking the forward-rotation (corresponding to the moving direction of the photosensitive belt) of the squeezing roller so as to permit the squeezing roller and the friction roll to rotate together, and for permitting free backward-rotation of the squeezing roller with respect to the friction roll in the drip line removing mode.

The friction roll is formed of a material having a high dry-friction coefficient, such as urethane. Also, any other materials can be used if a high dry-friction coefficient is guaranteed.

According to the preferred embodiment of the present invention, the squeezing apparatus includes: a squeezing roller for squeezing out and removing the carrier from a developer which is applied on the photosensitive belt by its passive-rotational movement while being pressed into tight contact with the photosensitive belt at a certain pressure together with a squeezing backup roller; a squeezing brush selectively coming in contact with the outer circumference of the squeezing roller, for cleaning the squeezing roller by being rotated by a separate driving section; and a squeezing roller slip prevention mechanism disposed on both ends of the shaft of the squeezing roller to come in tight contact with the squeezing backup roller during the pressing of the squeezing roller, for preventing any slipping of the squeezing roller with respect to the photosensitive belt.

Here, the squeezing brush is rotated by a driving force transmitted from the developing roller driving section, for removing residual carrier and ink toner left on the squeezing roller by being rotated faster than the squeezing roller.

Further, in the squeezing apparatus according to the present invention, the friction force between the squeezing brush and the squeezing roller is set to be less than the friction force between the squeezing roller slip prevention mechanism and the squeezing backup roller. Accordingly, even when the squeezing brush is rotated faster than the squeezing roller while in contact with the squeezing roller, the squeezing roller is not subjected to the torque of the squeezing brush, but is rotated at the same speed as the travel speed of the photosensitive belt. As a result, slipping does not occur between the photosensitive belt and the squeezing roller.

BRIEF DESCRIPTION OF THE DRAWINGS

The above and other objects and advantages of the present invention will become readily apparent by reference to the following detailed description when considered in conjunction with the accompanying drawings wherein.

DETAILED DESCRIPTION OF THE PREFERRED EMBODIMENT

Hereinafter, the preferred embodiment of the present invention will be described in greater detail with respect to the accompanying drawings.

Figure 1:
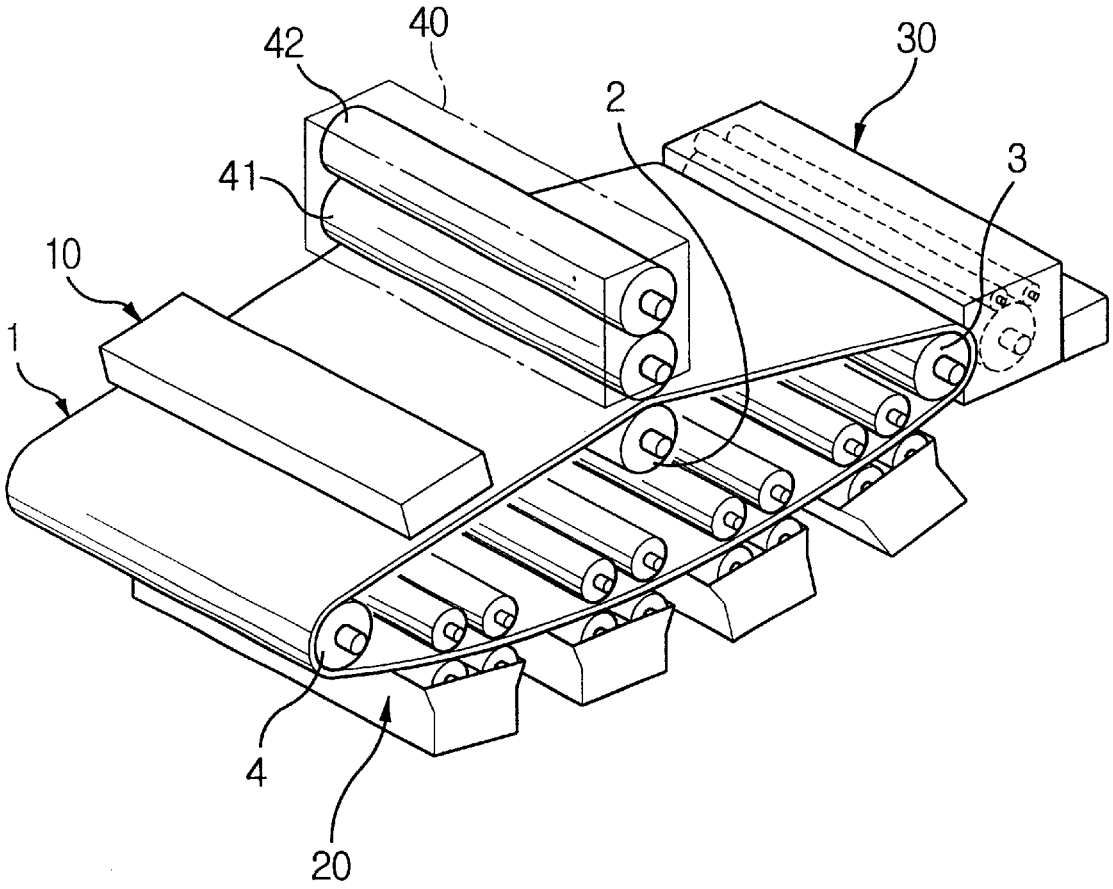
FIG. 1 (PRIOR ART)
FIG. 1 is a perspective view for schematically showing the main portions of a conventional liquid electrophotographic printer.
Figure 2:
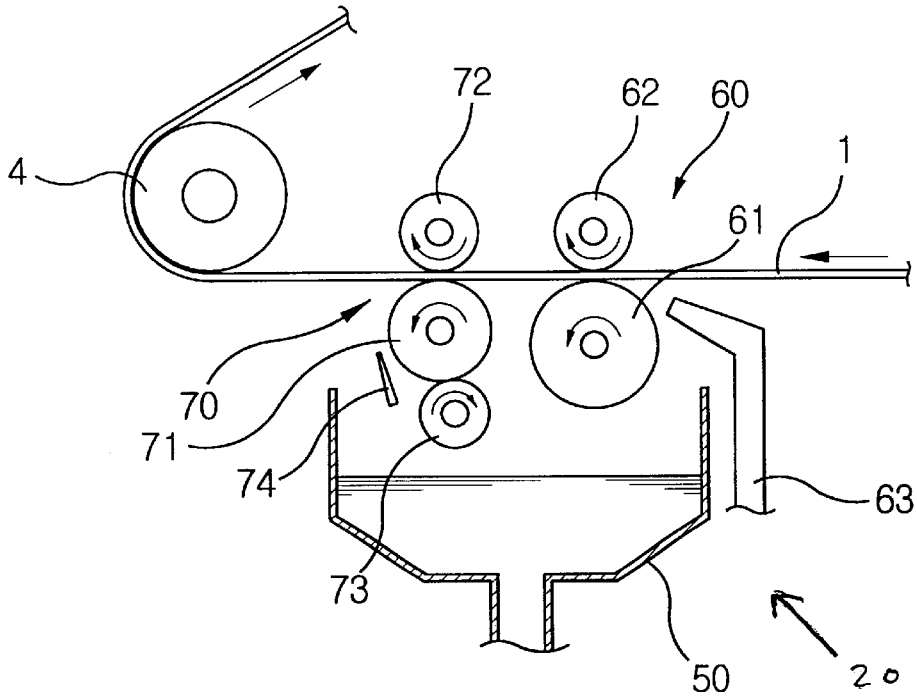
FIG.2 (PRIOR ART)
FIG. 2 is a view for showing one of the developer units of the printer of FIG. 1 in a printing mode.
Figure 3:
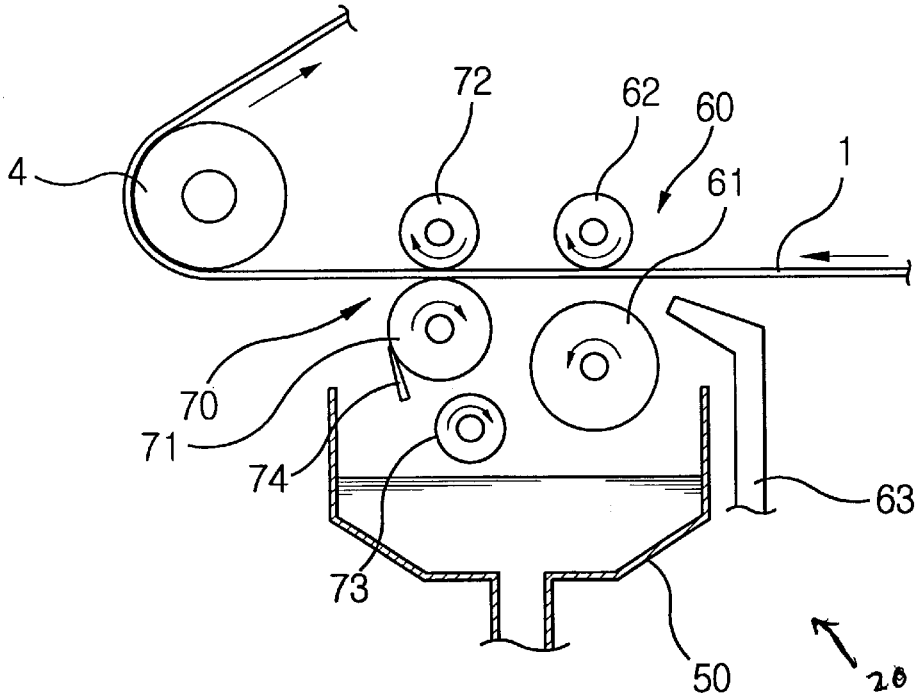
FIG.3 (PRIOR ART)
FIG. 3 is a conventional view for showing a drip line removing mode.
Figure 4:
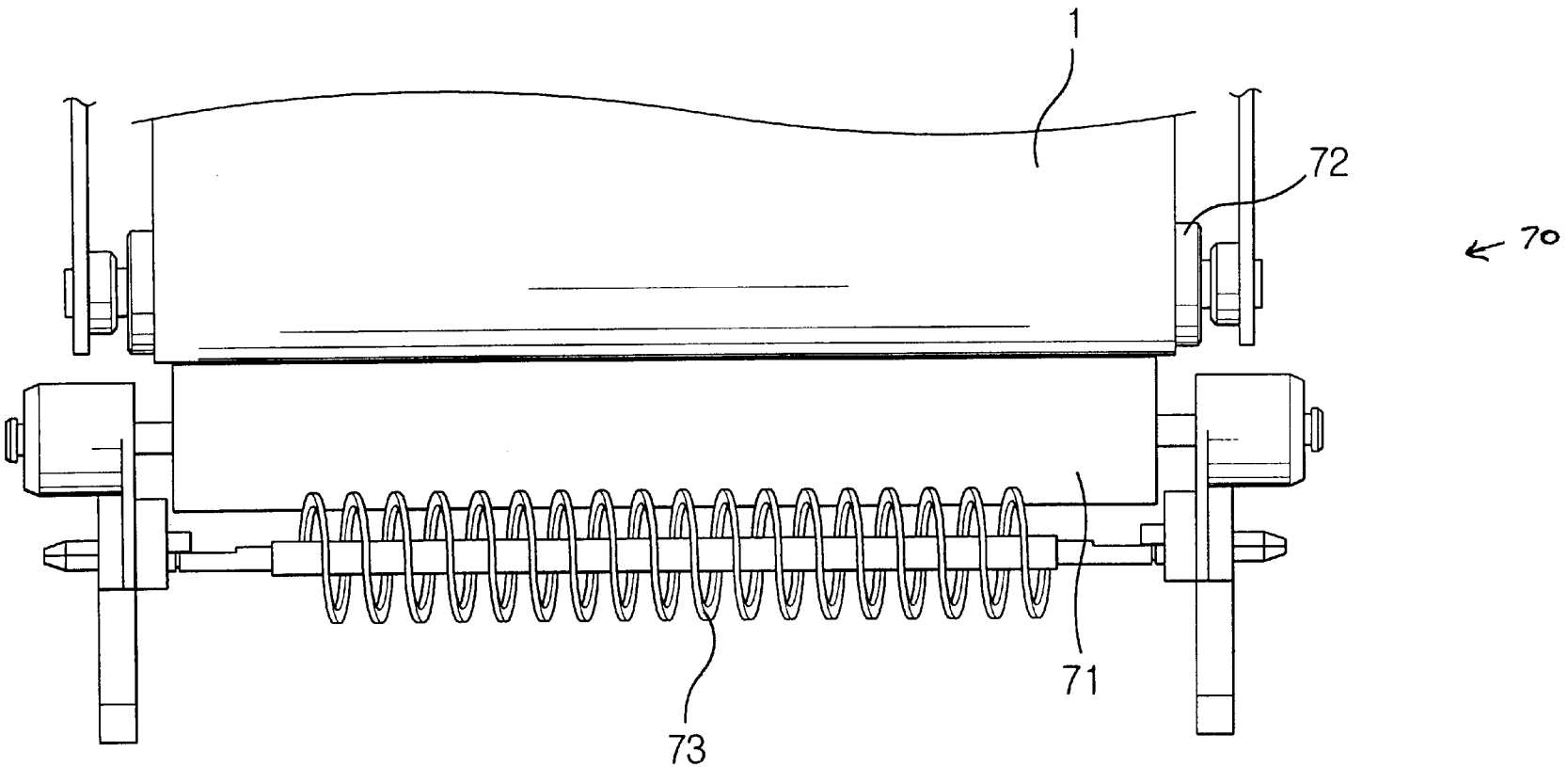
FIG. 4 (PRIOR ART)
FIG. 4 is a side sectional view of FIG. 2, for showing the structure of a conventional squeezing apparatus.
Figure 5:
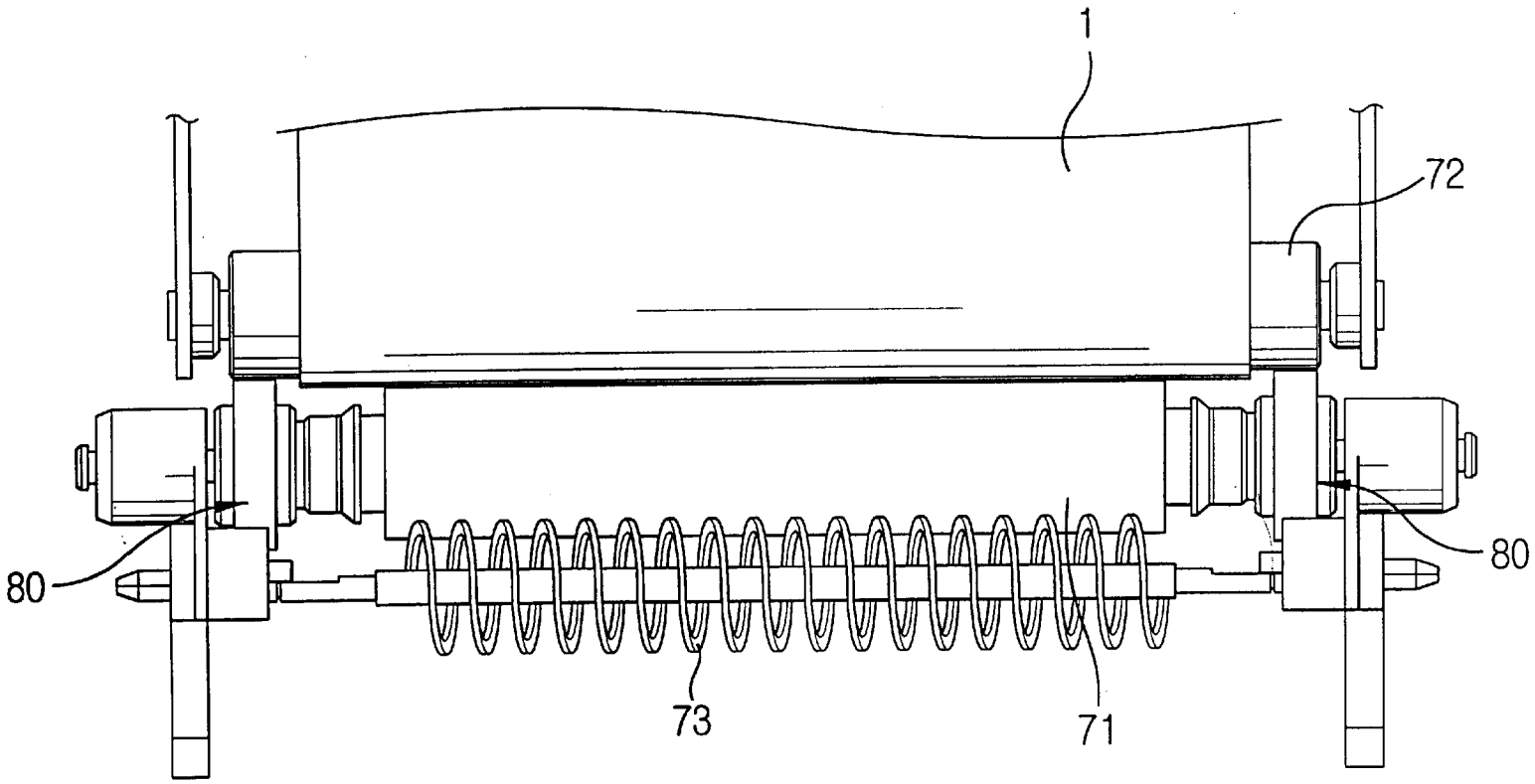
FIG. 5 is a view showing the structure of the squeezing apparatus according to a preferred embodiment of the present invention.
Figure 6:
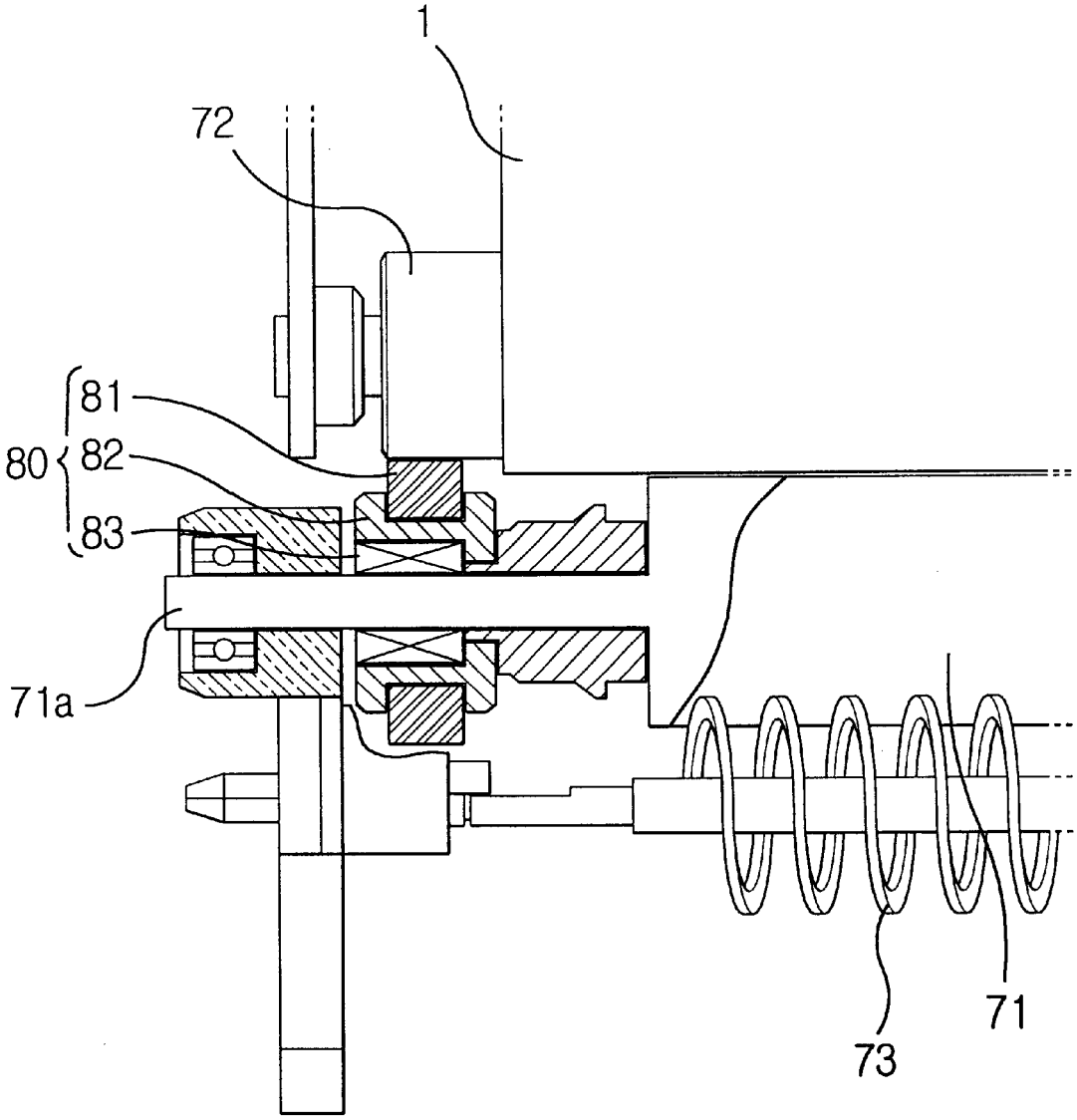
FIG. 6 is a sectional view for showing the main portion of the squeezing apparatus of FIG. 5.
Figure 7:
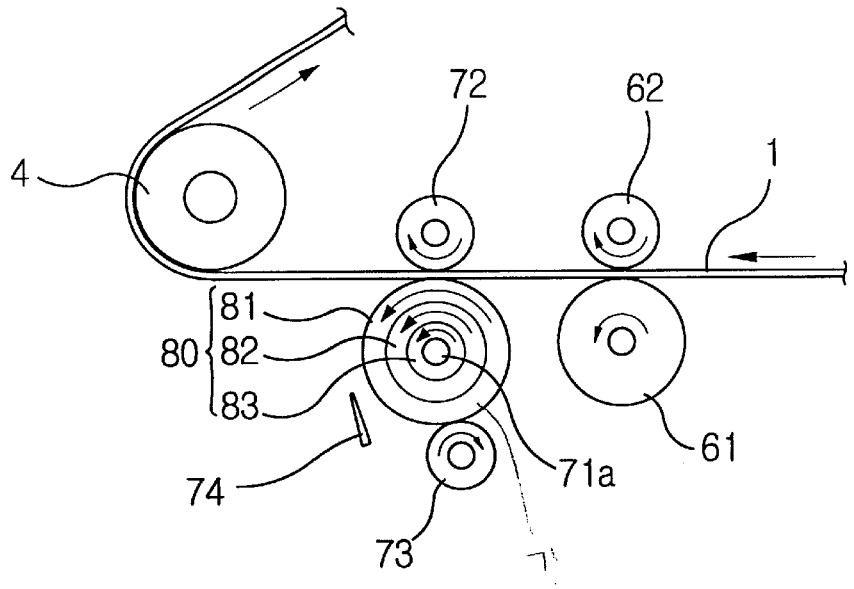
FIGS. 7 and 8 are views for showing the operation of the main portion of the squeezing apparatus according to the present invention, i.e., the slip prevention mechanism operating in the printing mode and the drip line removing mode.
Figure 8:
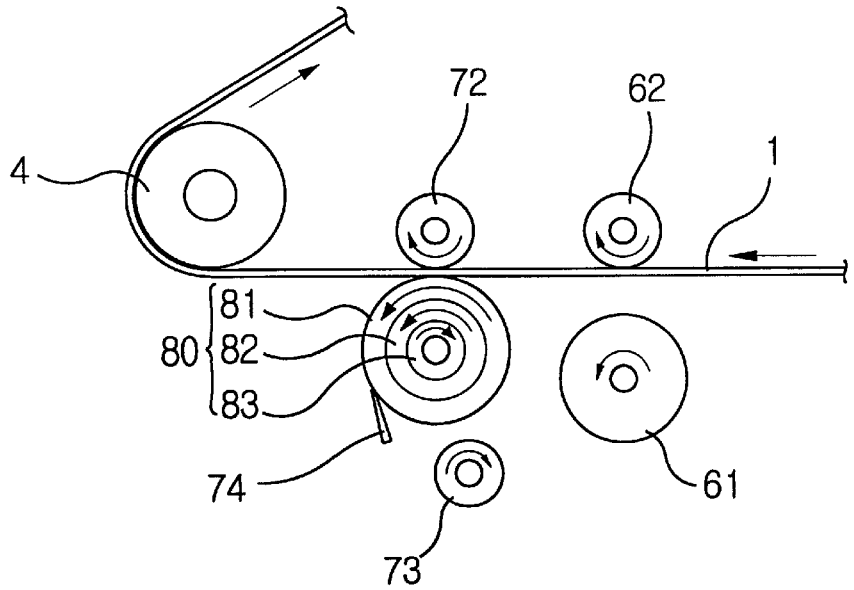

FIG. 5 shows the structure of the squeezing apparatus according to a preferred embodiment of the present invention. FIG. 6 shows the main portion of the squeezing apparatus of FIG. 5, and FIGS. 7 and 8 show the main portion of the squeezing apparatus, i.e., the slip prevention mechanism operating in the printing mode and the drip line removing mode. For a convenient explanation, the like elements will be designated by the same reference numerals throughout the description.

As shown in FIG. 5, the squeezing apparatus of liquid electrophotographic printer according to the present invention includes a squeezing roller 71, squeezing backup roller 72, a squeezing brush 73, and squeezing roller slip prevention mechanism 80.

The squeezing roller 71 and the squeezing backup roller 72 squeeze and remove the liquid carrier from the developer which is applied on the photosensitive belt 1 by its passive-rotational movement while being pressed into tight contact with the photosensitive belt 1 at a certain pressure (approximately at 20 kg/f) by a pressing section (not shown).

The squeezing brush 73 removes the carrier and/or ink toner attached on the squeezing roller 71 by being rotated in contact with the outer circumference of the squeezing roller 71 during the squeezing operation of the squeezing roller 71. The squeezing brush 73 is rotated by a driving force transmitted from a developing roller driving section which is not shown, and is rotated faster than the squeezing roller 71.

Meanwhile, the squeezing roller slip prevention mechanism 80 is disposed on both ends of a shaft 71*a* (FIG. 6) of the squeezing roller 71, for coming into tight contact with the squeezing backup roller 72 when pressing the squeezing roller 71. The squeezing roller slip prevention mechanism 80 comes into tight contact with the squeezing backup roller 72 by a high friction force when the squeezing roller 71 is pressed into tight contact with the photosensitive belt 1, so as to rotate at the same speed as the squeezing backup roller 72. Accordingly, due to the presence of the squeezing roller slip prevention mechanism 80 on the shaft 71*a* of the squeezing roller 71, the squeezing roller 71 is rotated at the same speed as the photosensitive belt 1. More specifically, even when loads are exerted from the squeezing brush 73, or from other elements, the squeezing roller 71 is not subjected to the loads, but keeps its rotation at the same speed as the photosensitive belt 1. Accordingly, slipping of the squeezing roller 71 with respect to the photosensitive belt 1 does not occur.

As shown in FIG. 6, the squeezing roller slip prevention mechanism 80 operating as above includes a friction roll 81 in friction-contact with the squeezing backup roller 72, a bush bearing 82 for supporting the friction roll 81 with respect to the shaft 71 a of the squeezing roller 71, and a one-way bearing 83 disposed between the bush bearing 82 and the shaft 71*a* of the squeezing roller 71. Here, the one-way bearing 83 is locked during the forward-rotation (corresponding to moving direction of the photosensitive belt 1) of the squeezing roller 71 so as to permit the squeezing roller 71 to rotate with the friction roll 81, and then permits the squeezing roller 71 to smoothly rotate with respect to the friction roll 81 during the backward-rotation of the squeezing roller 71 during the drip line removing mode.

The one-way bearing 83 is employed for the following reason. If the friction roll 81 is directly disposed on the shaft 71*a* of the squeezing roller 71, the friction roll 81 and the squeezing backup roller 72 are rotated in tight contact with each other by a high friction force, and even during the drip line removing mode, the squeezing backup roller 72 keeps rotating forward in the same direction as the direction in which the photosensitive belt 1 is moved, making it impossible for the squeezing roller 71 to rotate backwards.

However, by employing the one-way bearing 83, the forward-rotation between the friction roll 81 and the squeezing roller shaft 71*a* is locked, while the rotation to the backward direction is freely performed. Here, the "locking direction" corresponds to the moving direction of the photosensitive belt 1, while the "free direction" corresponds to the reverse direction of the moving direction of the photosensitive belt 1. Accordingly, the drip line removing mode can be smoothly performed.

Further, the friction roll 81 is made of a material having a high dry friction coefficient such as urethane, or any other material of a high dry friction coefficient. Here, the friction force between the friction roll 81 and the squeezing backup roller 72 is greater than the friction force between the squeezing roller 71 and the squeezing brush 73. Accordingly, if any load is generated by the squeezing brush 73, the squeezing roller 71 is not subject to the load, but is rotated at a uniform speed. Further, according to the structure of the present invention, the friction force between the photosensitive belt 1 and the squeezing roller 71 can be reduced, and the carrier can be exclusively squeezed out for removal from the developer without causing any damage to the image on the photosensitive belt 1.

Further, albeit not shown, the squeezing apparatus according to the present invention includes a driving section for reverse-rotating the squeezing roller 71 in the drip line removing mode, and a squeezing blade 74 for removing the ink toner attracted onto the squeezing roller 71 in contact with the outer circumference of the squeezing roller 71.

One unique feature that separates the invention from the conventional device, is that, as shown in FIG. 7, the friction roll 81 of the squeezing roller slip prevention mechanism 80 disposed on both ends of the shaft 71*a* of the squeezing roller 71 are rotated in tight contact with the squeezing backup roller 72 by a high friction force, when the squeezing roller 71 is pressed onto the photosensitive belt 1 along with the squeezing backup roller 72. Accordingly, the squeezing roller 71 is rotated at the same speed as the photosensitive belt 1, and squeezes out and removes the liquid carrier from the developer applied on the photosensitive belt 1. Further, the squeezing brush 73 removes the carrier and ink toner attached on the squeezing roller 71 by being rotated by a separate driving source in tight contact with the squeezing roller 71. Here, by the same reason as in the conventional case, the torque is transmitted to the squeezing roller 71 by the squeezing brush 73. According to the present invention, however, since the friction force between the friction roll 81 and the squeezing backup roller 72 is greater than the friction force between the squeezing roller 71 and the squeezing brush 73, the squeezing roller 71 is not subjected to the torque transmitted by the squeezing brush 73, but is rotated at the same speed as the photosensitive belt 1 to safely perform the squeezing operation.

After completion of the printing operation, the drip line removing mode is performed in which unnecessary ink toner attached on the photosensitive belt 1 is removed. In this situation, as shown in FIG. 8, the squeezing roller 71 is subjected to lower pressure than in the printing mode, and attracts unnecessary ink toner from the photosensitive belt 1 thereto while being reverse rotated by the driving section (not shown) in contact with the squeezing blade 74. The ink attracted onto the squeezing roller 71 is removed by the squeezing blade 74 which is in contact with the outer circumference of the squeezing roller 71. In such a situation, due to the one-way bearing 83 of the squeezing roller slip prevention mechanism 80 of the present invention, the friction roll 81 and the bush bearing 82 are rotated in the counterclockwise direction of FIG. 8 (corresponding to the moving direction of the photosensitive belt 1), and the squeezing roller shaft 71*a* is smoothly rotated clockwise (corresponding to the reverse direction in the printing mode) to thus remove the drip line of the photosensitive belt 1.

As described above, according to the present invention, since the squeezing roller is passively rotated while being pressed into tight contact with the squeezing backup roller by the squeezing roller slip prevention mechanism, the squeezing roller does not slip even when loads are exerted from the squeezing brush and/or other elements, but is rotated at the same speed as the travel speed of the photosensitive belt. Accordingly, the image blur caused due to the squeezing roller's slip is prevented, and high print quality can be obtained.

As stated above, the preferred embodiment of the present invention is shown and described. Although the preferred embodiment of the present invention has been described, it is understood that the present invention should not be limited to this preferred embodiment but various changes and modifications can be made by one skilled in the art within the spirit and scope of the present invention as hereinafter claimed.

What is claimed is:

1. A squeezing apparatus of a liquid electrophotographic printer comprising a squeezing roller for squeezing out and removing carrier from a developer which is applied on a photosensitive belt, by passive-rotational movement of the squeezing roller while being pressed into tight contact with the photosensitive belt at a certain pressure together with a squeezing backup roller, the squeezing apparatus further comprising:

a squeezing roller slip prevention mechanism disposed on both ends of a shaft of the squeezing roller to come into tight contact with the squeezing backup roller during pressing of the squeezing roller, for preventing any occurrence of slippage of the squeezing roller with respect to the photosensitive belt, the squeezing roller being rotated at a same speed as a travel speed of the photosensitive belt even when loads from other elements are exerted on the squeezing apparatus.

2. The apparatus as claimed in claim 1, wherein the slip prevention mechanism comprises:

a friction roll in friction contact with the squeezing backup roller;

a bush bearing for supporting the friction roll with respect to the shaft of the squeezing roller; and a one-way bearing disposed between the bush bearing and the squeezing roller, for locking a forward-rotation (corresponding to a moving direction of the photosensitive belt) of the squeezing roller so as to permit the squeezing roller and the friction roll to rotate together, while permitting free backward-rotation of the squeezing roller with respect to the friction roll in a drip line removing mode.

3. The apparatus as claimed in claim 2, wherein the friction roll is comprised of a material having a high dry-friction coefficient.

4. The apparatus as claimed in claim 3, wherein the material having a high dry-friction coefficient is urethane.

5. The apparatus as claimed in claim 2, wherein the loads comprise:

a self-load produced from roller deformation caused due to pressure from the squeezing roller;

a load between a supporting structure and a roller shaft; or a passive-load of a driving section connected for the drip line removing mode.

6. A squeezing apparatus of a liquid electrophotographic printer comprising a squeezing roller for squeezing out and removing carrier from a developer which is applied on a photosensitive belt, by passive-rotational movement of the squeezing roller while being pressed into tight contact with the photosensitive belt at a certain pressure together with a squeezing backup roller, the squeezing apparatus further comprising:

a squeezing brush selectively coming into contact with an outer circumference of the squeezing roller, for cleaning the squeezing roller by being rotated by a separate driving section; and a squeezing roller slip prevention mechanism disposed on both ends of a shaft of the squeezing roller to come into tight contact with the squeezing backup roller during pressing of the squeezing roller, for preventing any occurrence of slippage of the squeezing roller with respect to the photosensitive belt, the squeezing roller being rotated at a same speed as a travel speed of the photosensitive belt even when loads from the squeezing brush or other elements are exerted on the squeezing apparatus.

7. The apparatus as claimed in claim 6, wherein the squeezing brush is rotated by a driving force transmitted from a developing roller driving section at a first speed that is faster than a second speed of the squeezing roller, for removing residual carrier and ink toner left on the squeezing roller.

8. The apparatus as claimed in claim 6, wherein a first friction force between the squeezing brush and the squeezing roller is less than a second friction force between the squeezing roller slip prevention mechanism and the squeezing backup roller.

9. The apparatus as claimed in claim 6, wherein the slip prevention mechanism comprises:

a friction roll in friction contact with the squeezing backup roller;

a bush bearing for supporting the friction roll with respect to the shaft of the squeezing roller; and a one-way bearing disposed between the bush bearing and the squeezing roller, for locking a forward-rotation (corresponding to the moving direction of the photosensitive belt) of the squeezing roller so as to permit the squeezing roller and the friction roll to rotate together, while permitting free backward-rotation of the squeezing roller with respect to the friction roll in a drip line removing mode.

10. The apparatus as claimed in claim 9, wherein the friction roll is comprised of a material having a high dry-friction coefficient.

11. The apparatus as claimed in claim 10, wherein the material having a high dry-friction coefficient is urethane.

12. The apparatus as claimed in claim 9, wherein the loads comprise:

a self-load produced from roller deformation caused due to pressure from the squeezing roller;

a load between a supporting structure and a roller shaft; or a passive-load of a driving section connected for the drip line removing mode.

* * * * *